US007874884B1

(12) United States Patent
White et al.

(10) Patent No.: US 7,874,884 B1
(45) Date of Patent: Jan. 25, 2011

(54) COMPUTER CONTROLLED WATER BYPASS SYSTEM FOR A MARINE ENGINE

(75) Inventors: Brian R. White, Stillwater, OK (US); Dennis M. McClurg, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 657 days.

(21) Appl. No.: 11/978,286

(22) Filed: Oct. 29, 2007

(51) Int. Cl.

| | |
|---|---|
| ***B63H 21/38*** | (2006.01) |
| ***F01P 3/00*** | (2006.01) |
| ***F01P 3/02*** | (2006.01) |
| ***F01P 3/12*** | (2006.01) |
| ***F01P 3/20*** | (2006.01) |
| ***F01P 7/14*** | (2006.01) |

(52) U.S. Cl. ..... 440/88 R; 440/88 C; 440/88 G; 440/89 B; 123/41.02; 123/41.08; 123/41.29

(58) Field of Classification Search ..... 440/88 R, 440/88 C–88 M, 89 R, 89 B, 89 C; 60/317, 60/320, 321; 123/41.02, 41.05, 41.08, 41.09, 123/41.29, 41.41

See application file for complete search history.

(56) References Cited

U.S. PATENT DOCUMENTS

| | | | | |
|---|---|---|---|---|
| 3,105,472 | A * | 10/1963 | Jasper | 123/41.08 |
| 3,125,081 | A * | 3/1964 | Jasper | 123/41.09 |
| 3,319,614 | A * | 5/1967 | Shanahan | 123/41.08 |
| 3,380,466 | A * | 4/1968 | Sarra | 137/115.16 |
| 3,734,170 | A | 5/1973 | Pace | 165/51 |
| 3,780,712 | A | 12/1973 | Pace | 123/41.08 |
| 4,573,318 | A | 3/1986 | Entringer et al. | 60/ 310 |
| 4,866,934 | A | 9/1989 | Lindstedt | 60/321 |
| 4,977,741 | A | 12/1990 | Lulloff et al. | 60/310 |
| 4,991,546 | A | 2/1991 | Yoshimura | 123/41.31 |
| 5,032,095 | A | 7/1991 | Ferguson et al. | 440/89 |
| 5,109,668 | A | 5/1992 | Lindstedt | 60/310 |
| 6,652,337 | B1 | 11/2003 | Logan et al. | 440/88 J |
| 6,672,919 | B1 * | 1/2004 | Beson | 440/89 R |
| 6,821,171 | B1 * | 11/2004 | Wynveen et al. | 440/88 C |
| 6,929,520 | B1 | 8/2005 | Hughes et al. | 440/88 G |
| 7,065,961 | B1 | 6/2006 | Batten | 60/309 |
| 7,114,469 | B1 * | 10/2006 | Taylor | 123/41.08 |
| 7,264,520 | B1 * | 9/2007 | Taylor et al. | 440/88 HE |
| 7,318,396 | B1 * | 1/2008 | Belter et al. | 123/41.8 |

* cited by examiner

*Primary Examiner*—Ajay Vasudeva
(74) *Attorney, Agent, or Firm*—William D. Lanyi

(57) ABSTRACT

A method for controlling a marine engine uses a flow regulating valve in combination with a solenoid operated two position control valve to regulate the flow of cooling water through exhaust system components. Temperatures are measured at the components, such as within the cooling jacket of exhaust manifolds, and a microprocessor compares the measured temperatures to desired ranges. When the temperatures exceed upper limits, additional flow is directed from a pump to the exhaust system components. When the temperatures are below desired flow thresholds, the flow of the water in the pump is restricted in order to allow the exhaust system components to rise in temperature.

2 Claims, 2 Drawing Sheets

COMPUTER CONTROLLED WATER BYPASS SYSTEM FOR A MARINE ENGINE

BACKGROUND OF THE INVENTION

1. Field of the Invention

The present invention is generally related to exhaust cooling systems for marine engines and, more particularly, to an exhaust cooling system for marine propulsion units in which water flow through exhaust manifolds is controlled by a microprocessor that receives information regarding the temperature of the water within the manifolds and then controls the flow into the manifold as a function of that measured temperature.

2. Description of the Related Art

Exhaust systems for marine propulsion devices have used water, typically drawn from a body of water, as the cooling medium to regulate the temperature of the exhaust components.

U.S. Pat. No. 3,734,170, which issued to Pace on May 22, 1973, describes a marine engine cooling system. Improved water jacketed manifolds for marine engine cooling systems of the type wherein heated water which is circulated through an engine cooling system for cooling purposes is mixed in the improved engine exhaust manifold water jacket is described. The heated water is mixed with raw, relatively cool water to controllably cool the manifold and avoid condensing water from the exhaust gases flowing through the exhaust manifold.

U.S. Pat. No. 3,780,712, which issued to Pace on Dec. 25, 1973, describes a marine engine cooling system. This patent is a division of U.S. Pat. No. 3,734,170.

U.S. Pat. No. 4,573,318, which issued to Entringer et al. on Mar. 4, 1986, discloses an exhaust elbow for a marine propulsion system. The elbow has an intake exhaust passage extending upwardly from the engine and communicating through a bend with a discharge exhaust passage, and a water jacket has pockets around the exhaust passages for cooling the latter. A central channel extends longitudinally along the exterior of the exhaust passages to guide water to the end of the discharge exhaust passage to mix with exhaust. The central channel has a pair of side walls extending longitudinally and laterally tapered away from each other at the outer end of the discharge exhaust passage to create an outward draw from the central channel to minimize breakup of longitudinally outward water flow and maintain the end tip of the discharge exhaust passage dry and prevent water ingestion and creeping back into the discharge exhaust passage due to pulsations of the engine.

U.S. Pat. No. 4,866,934, which issued to Lindstedt on Sep. 19, 1989, discloses a marine drive exhaust system with shaped O-ring seals. The system is provided with resilient, shaped rubber O-ring seals between facing surfaces of the exhaust manifold and exhaust elbow and the facing surfaces of the exhaust elbow and the exhaust pipe. Each of the shaped O-ring seals has an inner peripheral rib extending peripherally around the exhaust passage and generally conforming to the shape thereof. They are spaced laterally between the exhaust passage and the peripheral water passages.

U.S. Pat. No. 4,977,741, which issued to Lulloff et al. on Dec. 18, 1990, discloses a combination exhaust manifold and exhaust elbow for a marine propulsion system. It includes an exhaust cavity for receiving exhaust from the engine, an exhaust passage leading from the exhaust cavity, and an exhaust discharge outlet. A first water jacket is provided around the exhaust cavity and a second water jacket is provided around the exhaust discharge passage. A dam is provided between the first and second water jackets, having a passage therein for allowing fluid communication between the first and second water jackets.

U.S. Pat. No. 4,991,546, which issued to Yoshimura on Feb. 12, 1991, describes a cooling device for a boat engine. An engine cooling jacket delivers its coolant to an exhaust manifold cooling jacket adjacent the inlet of the exhaust manifold and coolant is delivered from the exhaust manifold cooling jacket to a further cooling jacket around the inlet portion of an exhaust elbow.

U.S. Pat. No. 5,032,095, which issued to Ferguson et al. on Jul. 16, 1991, describes a marine engine with galvanic circuit protection. An engine includes a cooling jacket and an exhaust port, an exhaust gas discharge system includes an exhaust gas manifold communicating with the exhaust port, and a high rise elbow communicates with the exhaust gas manifold. An exhaust pipe communicates with the high rise elbow and is adapted to convey exhaust gas to an overboard discharge. A high rise elbow and exhaust gas manifold cooling jacket surrounds the exhaust gas manifold and at least partially surrounds the high rise elbow and communicates with the exhaust pipe for discharge of coolant from the high rise elbow and exhaust gas manifold cooling jacket.

U.S. Pat. No. 5,109,668, which issued to Lindstedt on May 5, 1992, discloses a marine exhaust manifold and elbow. The exhaust assembly includes a manifold portion, an elbow portion, a water jacket portion, and exhaust runner walls. It provides a smooth continuous transition of exhaust gas flow from the intake exhaust passages in the manifold portion to transfer exhaust passages in the elbow portion around a bend to a discharge exhaust passage. This minimizes turbulent flow of exhaust through the manifold portion and elbow portion.

U.S. Pat. No. 6,652,337, which issued to Logan et al. on Nov. 25, 2003, discloses an exhaust system for a marine propulsion engine. The system provides a relationship between the exhaust passages and coolant passages of the exhaust manifold and exhaust elbow which serves to maintain the joint of the exhaust passage at a higher temperature than would be possible with known exhaust manifolds and exhaust elbows. By providing a space between the surfaces of a raised exhaust portion of the components and surfaces of the raised coolant portions of the exhaust system, leakage from the coolant conduits of the exhaust cavities is avoided.

U.S. Pat. No. 6,672,919, which issued to Beson on Jan. 6, 2004, describes a temperature control system for a marine exhaust system. The control system lowers flow of cooling water to water jacket and exhaust gas conduit portions of the exhaust system at low engine speeds. The control system is typically activated at and below a predetermined engine speed. Once activated the control system operates to reduce flow of cooling water to the exhaust system.

U.S. Pat. No. 6,929,520, which issued to Hughes et al. on Aug. 16, 2005, discloses a cooling method for a marine propulsion system. The method directs a portion of a recirculating stream of cooling water to a first portion of an exhaust manifold so that a cooling jacket of the exhaust manifold can be maintained in a filled condition. Water flows upwardly through the cooling jacket and exits through a port in the exhaust manifold back into the recirculating stream of cooling water that passes through a recirculation pump, the cooling passage of an engine, and a cavity of a thermostat housing.

U.S. Pat. No. 7,065,961, which issued to Batten on Jun. 27, 2006, discloses an exhaust system with an integral moisture trap. The trap is formed as an integral part of the wall of an exhaust conduit. Tapered surfaces can be provided to direct condensate downwardly and into a reservoir of the moisture trap where the moisture is retained until the temperature of the exhaust system reaches adequate magnitude to evaporate the water and conduct it out of the exhaust system along with exhaust gases.

The patents described above are hereby expressly incorporated by reference in the description of the present invention.

When exhaust components are cooled with water drawn from a body of water, it presents several difficulties that must be addressed. First, when the exhaust system components have not reached their maximum or near maximum temperatures, provision of cold water can cause condensation within those exhaust components. The condensation can lead to several disadvantageous conditions that are well known to those skilled in the art. On the other hand, if adequate cooling water is not provided when the engine is operating at its maximum or near maximum heat production levels, exhaust system components can quickly overheat and be damaged. It is therefore significantly beneficial if a system can be provided to control the flow of water to the exhaust system components, such as exhaust manifolds and exhaust elbows, in a manner that neither overcools nor overheats those components.

SUMMARY OF THE INVENTION

A method for controlling a marine engine, in accordance with a preferred embodiment of the present invention, comprises the steps of providing a pump, pumping water from a body of water, directing a first portion of the water toward exhaust system components of the marine engine, providing a flow regulating valve which is configured to control the flow of the first portion of water toward the exhaust system components, measuring a first temperature of the exhaust system components, increasing the flow of the first portion of the water when the first temperature is above an upper threshold and decreasing the flow of the first portion of the water when the first temperature is below a lower threshold. The flow regulating valve is disposed in fluid communication between the pump and the exhaust system components in a preferred embodiment of the present invention.

The exhaust system components can comprise an exhaust manifold of the engine. The flow regulating valve can be a poppet valve.

In a preferred embodiment of the present invention, it can further comprise the step of providing a two position control valve which is operatively connected to the flow regulating valve to cause the flow regulating valve to selectively perform the increasing and decreasing steps. In addition, in certain embodiments of the present invention, it can further comprise the step of directing a second portion of the water through a coolant, passage of the marine engine, controlling the flow of the second portion of the water through the coolant passage of the marine engine as a function of the second temperature of the second portion of the water within the marine engine, and conducting the second portion of the water toward the exhaust system components when the second temperature of the second portion of the water within the marine engine exceeds a preselected engine temperature. The controlling step can be performed by a thermostat.

In certain embodiments of the present invention, it can further comprise the step of directing a third portion of the water toward the exhaust system components of the marine engine.

In a preferred embodiment of the present invention, the increasing and decreasing steps are controlled by a microprocessor as a function of the first temperature of the exhaust system components. Also, in a preferred embodiment of the present invention, the exhaust system components comprise two exhaust manifolds and two exhaust elbows.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
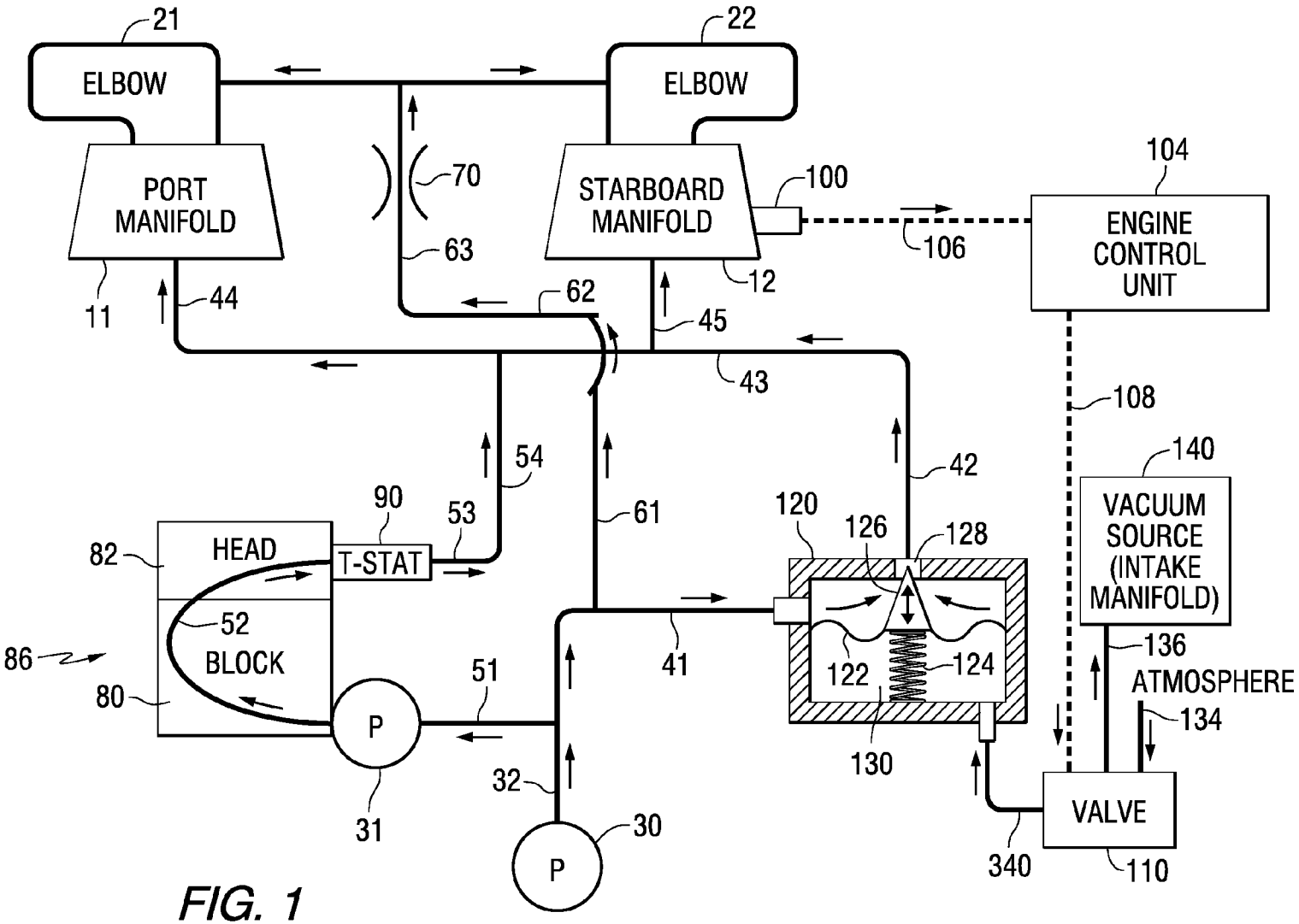
FIG. 1 shows a preferred embodiment of the present invention in which a single flow regulating valve is used.

Throughout the description of the preferred embodiment of the present invention, like components will be identified by like reference numerals.

Figure 2:
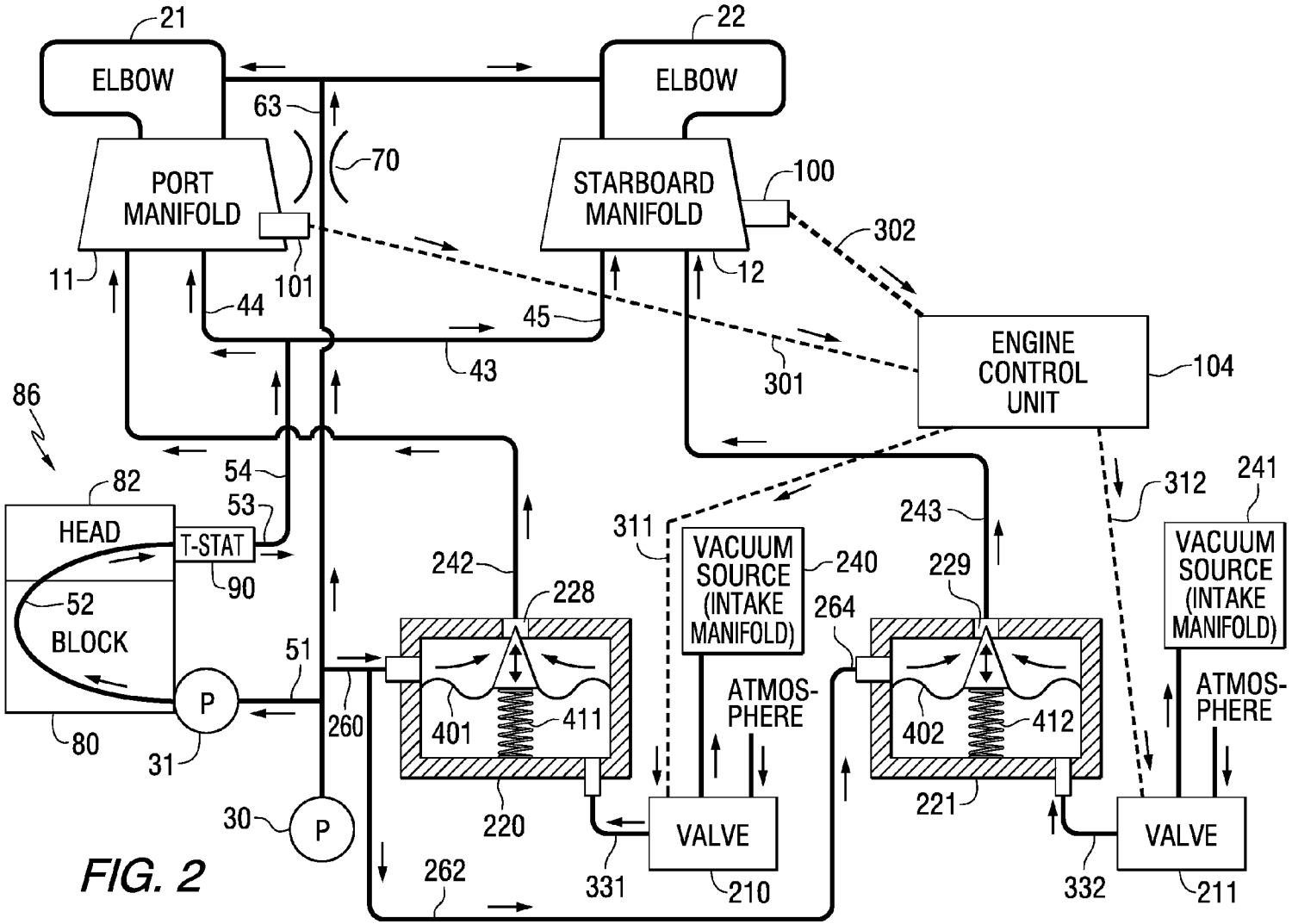
FIG. 2 shows an embodiment of the present invention in which two flow regulating valves are used.

FIG. 1 is a schematic representation of a preferred embodiment of the present invention. In FIG. 1, as will be described in detail below, a single measurement is taken of the water temperature of the manifold and certain decisions are based on that single temperature measurement. However, this simplifying of the system is not required in all embodiments of the present invention and, as will be described in conjunction with FIG. 2, is typically not employed in most applications. However, it should be understood that the single temperature reading procedure described in conjunction with FIG. 1 is intended to simplify the initial discussion and explain the basic principles of the present invention.

With continued reference to FIG. 1, it can be seen that a first exhaust manifold 11 and a second exhaust manifold 12 are associated with a first exhaust elbow 21 and a second exhaust elbow 22, respectively. The cooling system shown in FIG. 1 actually comprises three coolant paths that operate with relative independence to each other as will be explained. A pump 30 draws water from a body of water and causes the water to flow under pressure to the cooling system as represented by arrow 32. A first portion of the water flows through a path which is represented by arrows 41-45 in FIG. 1. A second portion of the water drawn by the pump 30 flows through a path represented by arrows 51-54. A third portion of the water drawn by the pump 30 from the body of water flows along a coolant path represented by arrows 61-63.

The third coolant path, 61-63, directs a portion of the water drawn by the pump 30 through a restriction device 70 to the exhaust elbows, 21 and 22. This water flows as long as the pump 30 is operating. It provides a relatively small quantity of water to the exhaust elbows whenever the engine is operating. The second passage of water, 51-54, directs water from the pump 30 into the block 80 and head 82 of an engine 86. The flow of water 52 through the block and head, 80 and 82, is controlled by a thermostat 90 which maintains the overall temperature of water flowing through the engine 86. When the temperature of the water exceeds the threshold temperature of the thermostat 90, water is allowed to flow through the portion of the passage identified by arrows 53 and 54 to the manifolds, 11 and 12. This water then cools the manifolds. Although not shown in FIG. 1, it should be understood that after flowing through the manifolds and/or elbows, the water is discharged and returned to the body of water from which it was drawn by the pump 30.

The temperature of the water in the starboard manifold 12 is measured by a temperature sensor 100. The information relating to the temperature magnitude which is read by the temperature sensor 100 is conveyed to an engine control unit (ECU) 104 as represented by dashed line arrow 106. That information relating to the temperature of water within the manifold 12 is used, by the ECU 104, to determine whether or not the temperature is within a predetermined acceptable range. Based on a comparison of the temperature from the sensor 100 to that acceptable range, the engine control unit 104 provides a signal on dashed line arrow 108 which affects the status of a two position control valve 110 which will be described in greater detail below. A flow regulating valve 120 is used to control the flow of cooling water from the passage identified by arrow 41 to the passage identified by arrow 42.

In the embodiment of the present invention illustrated in FIG. 1, the flow regulating valve 120 is shown having a diaphragm 122, a spring 124, and a device 126 that can move into blocking relationship with an opening 128. The upward and downward movement of the device 126, or poppet, allows the flow of water to be regulated between the portions of the circuit identified by arrows 41 and 42. The valve 110, in response to commands from the engine control unit 104, connects the lower portion 130 of the two position control valve 120, below the diaphragm 122, to either atmospheric pressure identified by arrow 134 or a vacuum source, identified by arrow 136. The vacuum source can typically be the intake manifold of the engine 86. When connected to atmospheric pressure, the lower region 130 of the flow regulating valve 120 allows the spring 124 to move the poppet 126 into a blocking relationship with respect to opening 128. This blocks the flow of water to the passage identified by arrow 42 and, as a result, to the manifolds. When the lower region 130 is connected to the vacuum source 140, it works against the spring 124 to lower the diaphragm 122 and poppet 126 and open the opening 128. This allows flow from the pump 30 to the manifolds. In operation, when the temperature sensed by the sensor 100 indicates that the temperature of the manifold is above a preselected range of appropriate temperatures, the poppet 126 can be moved downwardly to allow a flow of water from the pump 30 to the manifolds and, as a result, lower the temperature of the water within the manifolds. If, on the other hand, the temperature sensed by the sensor 100 is below a desirable temperature, the poppet 126 can be moved upwardly to block opening 128 and stop the additional flow of water which is identified above as the first portion of the water pumped by the pump 30.

With continued reference to FIG. 1, several characteristics can be seen with regard to the structure and operation of the present invention. For example, the flow regulating valve 120 is disposed in fluid communication between the pump 30 and the exhaust system components, 11 and 12, which are manifolds in this example. Arrows 32 and 41 are illustrated between the pump 30 and the flow regulating valve 120 and arrows 42-45 are illustrated between the flow regulating valve 120 and the manifolds, 11 and 12.

FIG. 2 is generally similar to FIG. 1 in certain aspects, but it shows an embodiment of the present invention in which two flow regulating valves, 220 and 221, are used. Each of the flow regulating valves is associated with one of the manifolds, 11 or 12. It should be understood that the cooling passages associated directly with the engine 86 and the restriction 70, described above as the second and third portions of the cooling water flow, are generally similar to that described above in conjunction with FIG. 1 and will not be discussed in the following description.

It can be seen in FIG. 2 that a first flow regulating valve 220 receives water from the pump 30 through the line represented by arrow 260 and controls the flow of water through opening 228 along arrow 242 to the first manifold 11. The flow regulating valve 220 operates in a manner similar to that described above in conjunction with FIG. 1 and flow regulating valve 120. Some of the water from the pump 30 is directed as represented by arrows 262 and 264, to a second flow regulating valve 221. It also operates similar to the valve 120 described above in conjunction with FIG. 1. The engine control unit 104 receives temperature information on line 301 from a first temperature sensor 101 and on line 302 from temperature sensor 100. This information is used by the engine control unit 104 to compare with desired flow temperature ranges for the port and starboard manifolds, 11 and 12, respectively. That information allows the engine control unit 104 to provide signals, on lines 311 and 312, to the solenoid operated two position control valves, 210 and 211, respectively. These two position control valves are known to those skilled in the art as 3-way, 2-position valves and are typically solenoid operated. They connect their output, 331 and 332, to either atmospheric pressure or a vacuum source as described above in conjunction with valve 110 and its output 340. This connection either draws the diaphragm, 401 or 402, downwardly against the operation of the spring, 411 or 412, respectively. In turn, this opens and closes the opening of the flow regulating valve, 220 and 221.

With continued reference to FIG. 2, if the temperature sensed by the temperature sensors, 100 and 101, indicate that a change is called for in either of the two manifolds, the engine control unit 104 manipulates the solenoid operated two position control valve, 220 and 221, to allow flow from the pump 30 to the manifold. When either of the temperatures exceeds an upper threshold, water flow from the pump 30 to that manifold, is increased. If the temperature sensor senses that the temperature of the associated manifold is below a lower threshold, the associated opening, 228 or 229, is closed to allow the temperature of the cooled manifold to rise. It can be seen that the flow control valve, 220 or 221, is located between the pump 30 and its associated manifold, 11 or 12.

With continued reference to FIGS. 1 and 2, it can be seen that a preferred embodiment of the present invention provides a method that comprises the steps of providing the pump 30, pumping water from a body of water, directing a first portion of the water toward the exhaust system, 11 and 12, of the marine engine, providing a flow regulating valve, 120, 220, and 221, which is configured to control the flow of a first portion of the water toward the exhaust system components. The flow regulating valve is disposed in fluid communication between the pump 30 and the exhaust system components. The preferred embodiment of the present invention further comprises the step of measuring a temperature of the exhaust system components. This is done by using temperature sensor 100 in FIG. 1 and sensors 100 and 101 in FIG. 2. A preferred embodiment of the present invention further comprises the step of regulating the flow of the first portion of the water as a function of the temperatures received from the temperature sensors.

With continued reference to FIGS. 1 and 2, the exhaust system components comprise exhaust manifolds, 11 and 12, of a marine engine and/or exhaust elbows, 21 and 22. The regulating step is controlled, in a preferred embodiment of the present invention, by a microprocessor of an engine control unit 104 as a function of the temperature of the exhaust system components as measured by the sensors, 100 and 101. A preferred embodiment of the present invention further comprises the step of directing a second portion of the water through a cooling passage of an engine 86, controlling the flow of the second portion through the cooling passage 52 of the marine engine 86 as a function of a second temperature, measured by the thermostat 90, conducting the second portion of water toward the exhaust system components, 11 and 12, whenever the second temperature of the second portion of water exceeds a preselected engine temperature as determined by the thermostat 90, and directing a third portion of the water through a passage comprising the flow restrictor 70.

Although the present invention has been described with particular detail and illustrated to show different embodiments, it should be understood that alternative embodiments are also within its scope.

We claim:

1. A method for controlling a marine engine comprising:

providing a pump;

pumping water from a body of water;

providing said engine with an exhaust passage through an exhaust manifold and an exhaust elbow;

providing said engine with a block and a head and a cooling passage through said block and said head;

directing first, second and third portions of said water separately to cool the same said exhaust passage along first, second and third parallel flow paths, respectively;

providing at least first and second flow control valves;

providing said first flow control valve along said first flow path;

providing said second flow control valve along said second flow path in series with said cooling passage through said block and said head, and in parallel with said first flow control valve in said first flow path;

directing said first portion of said water along said first flow path through said first flow control valve to cool said exhaust passage;

directing said second portion of said water along said second flow path in series through said cooling passage through said block and said head and said second flow control valve to cool the same said exhaust passage, in parallel with said first flow control valve in said first flow path;

directing said third portion of said water along said third flow path to cool the same said exhaust passage, in parallel with said first flow control valve in said first flow path and in parallel with said second flow control valve and said cooling passage through said block and said head in said second flow path;

controlling said first flow control valve according to a temperature condition of said exhaust passage;

controlling said second flow control valve according to a temperature condition along said second flow path through said cooling passage through said block and said head.

2. The method according to claim 1 comprising:

controlling said first flow control valve with an ECU, engine control unit, responding to temperature of said exhaust passage;

providing said second flow control valve as a thermostat;

providing a restrictor along said third flow path;

directing said third portion of said water along said third flow path in parallel with said first and second flow control valves and through said restrictor to cool said exhaust passage.

* * * * *